US011944208B2

(12) United States Patent
Snyder et al.

(10) Patent No.: US 11,944,208 B2
(45) Date of Patent: Apr. 2, 2024

(54) CHAIR AND METHOD OF MAKING THE CHAIR

(71) Applicant: Knoll, Inc., East Greenville, PA (US)

(72) Inventors: Ronald Snyder, East Greenville, PA (US); Adam Deskevich, East Greenville, PA (US); Nick Max, East Greenville, PA (US)

(73) Assignee: Knoll, Inc., East Greenville, PA (US)

( * ) Notice: Subject to any disclaimer, the term of this patent is extended or adjusted under 35 U.S.C. 154(b) by 20 days.

(21) Appl. No.: 17/825,612

(22) Filed: May 26, 2022

(65) Prior Publication Data

US 2022/0395100 A1 Dec. 15, 2022

Related U.S. Application Data

(60) Provisional application No. 63/210,214, filed on Jun. 14, 2021.

(51) Int. Cl.

| | |
|---|---|
| ***A47C 7/44*** | (2006.01) |
| ***A47C 3/04*** | (2006.01) |
| ***A47C 7/24*** | (2006.01) |
| ***A47C 7/40*** | (2006.01) |

(52) U.S. Cl.

CPC ..... *A47C 7/24* (2013.01); *A47C 3/04* (2013.01); *A47C 7/40* (2013.01)

(58) Field of Classification Search

CPC .... A47C 3/04; A47C 7/24; A47C 7/40; A47C 7/44

USPC ..... 297/440.2, 446.1, 446.2, 291, 239

See application file for complete search history.

(56) References Cited

U.S. PATENT DOCUMENTS

| | | | | | |
|---|---|---|---|---|---|
| 1,775,433 | A | * | 9/1930 | Krabol | A47C 7/441 297/291 |
| 2,649,136 | A | * | 8/1953 | Eames | A47C 7/002 297/285 |
| 2,796,920 | A | * | 6/1957 | Cowles | A47C 7/448 297/291 X |
| 2,821,450 | A | | 1/1958 | Knoll | |
| D183,722 | S | * | 10/1958 | Cohen | 297/446.1 X |
| 3,328,084 | A | * | 6/1967 | Whitener | A47C 7/002 297/446.1 X |

(Continued)

FOREIGN PATENT DOCUMENTS

| | | | | | |
|---|---|---|---|---|---|
| KR | 20130000737 U | * | 1/2013 | | A47C 7/44 |
| KR | 1591947 B1 | * | 2/2016 | | A47C 7/44 |
| TW | 316675 U | * | 8/2007 | | A47C 7/40 |

*Primary Examiner* — Rodney B White

(74) *Attorney, Agent, or Firm* — Buchanan Ingersoll & Rooney PC

(57) ABSTRACT

A chair can include a base having at least one chair back attachment mechanisms that attach a back of the chair to the base of the chair. The chair back attachment mechanisms can be positioned on an upper portion of the frame of the base of the chair to support the chair back. In some embodiments, there may be a single chair back attachment mechanism or only a pair of chair back attachment mechanisms to attach the chair back to the base. The chair back can be positioned via the chair back attachment mechanisms so that there is a gap between the lower portion of the chair back and the seat. Embodiments of the chair can be armless. Other embodiments can include arms positioned above the seat on opposite sides of the seat to support arms of a user sitting on the seat of the chair.

13 Claims, 6 Drawing Sheets

(56) References Cited

U.S. PATENT DOCUMENTS 3,455,605 A * 7/1969 Anderson ..... A47C 5/12 297/446.2 X
3,934,930 A * 1/1976 Sandham ..... A47C 7/445 297/291 X
4,248,325 A 2/1981 Georgopoulos
4,316,632 A * 2/1982 Brauning ..... A47C 7/46 297/291 X
4,325,597 A 4/1982 Morrison
4,382,642 A 5/1983 Burdick
4,400,032 A * 8/1983 dePolo ..... A47C 7/441 297/291 X
4,546,889 A 10/1985 Schoumaker et al.
4,567,698 A 2/1986 Morrison
4,604,955 A 8/1986 Fleischer et al.
4,850,647 A * 7/1989 Engel ..... A47C 3/00 297/446.1 X
4,955,667 A * 9/1990 Brunner ..... A47C 7/00 297/446.1
5,086,597 A 2/1992 Kelley et al.
5,224,429 A 7/1993 Borgman et al.
5,287,909 A 2/1994 King et al.
5,309,686 A 5/1994 Underwood et al.
5,328,260 A 7/1994 Beirise
5,408,940 A 4/1995 Winchell
5,562,052 A 10/1996 Glashouwer et al.
5,598,789 A 2/1997 Jonker
5,675,946 A 10/1997 Verbeek et al.
5,680,893 A 10/1997 Neer
5,706,739 A 1/1998 Shaheen et al.
5,715,761 A 2/1998 Frattini
5,881,979 A 3/1999 Rozier, Jr. et al.
5,906,420 A 5/1999 Rozier, Jr. et al.
5,941,182 A 8/1999 Greene
5,943,966 A 8/1999 Machado et al.
5,966,879 A 10/1999 Verbeek et al.
6,000,180 A 12/1999 Goodman et al.
6,002,613 A 12/1999 Cloud et al.
6,017,092 A * 1/2000 Lee ..... A47C 3/00 297/446.2 X
6,029,587 A 2/2000 Rozier, Jr. et al.
6,067,762 A 5/2000 Greer et al.
D427,783 S 7/2000 Luedke
6,106,061 A * 8/2000 Caruso ..... A47C 1/124 297/239
6,116,687 A * 9/2000 Vogtherr ..... A47C 7/448 297/291 X
6,167,664 B1 1/2001 Reuter et al.
6,367,213 B1 4/2002 Reuter et al.
D457,359 S 5/2002 Chan
6,389,988 B1 5/2002 Frattini
D458,040 S 6/2002 Stannis et al.
6,536,357 B1 3/2003 Hiestand
6,546,880 B2 4/2003 Agee
6,817,667 B2 11/2004 Pennington et al.
6,824,218 B1 11/2004 van Hekken
6,896,028 B2 5/2005 Brennan
7,198,329 B1 4/2007 Larson
7,278,688 B1 * 10/2007 Hung ..... A47C 7/448 297/285
7,310,918 B1 12/2007 Reuter et al.
7,427,107 B2 * 9/2008 Yang ..... A47C 7/405 297/354.11
7,490,901 B2 * 2/2009 Maier ..... A47C 7/448 297/291
7,789,025 B2 9/2010 Michaud, II et al.
7,887,131 B2 2/2011 Chadwick et al.
8,029,060 B2 10/2011 Parker et al.
8,056,489 B2 11/2011 Nielsen
D653,862 S 2/2012 Hairston
8,132,371 B2 3/2012 Golinski et al.
8,152,237 B2 * 4/2012 Saul ..... A47C 3/04 297/239
8,157,329 B2 4/2012 Masoud et al.
8,167,373 B2 5/2012 Allison et al.
8,216,416 B2 7/2012 Allison et al.
8,256,359 B1 9/2012 Agee
8,347,796 B2 1/2013 Udagawa et al.
8,365,798 B2 2/2013 Feldpausch et al.
8,667,909 B2 3/2014 Ruzicka
9,185,973 B2 11/2015 Udagawa et al.
9,265,340 B2 2/2016 Krusin et al.
9,585,468 B2 3/2017 Udagawa et al.
9,730,513 B2 8/2017 Udagawa et al.
D796,216 S 9/2017 Rockwell et al.
D800,459 S 10/2017 Rockwell et al.
9,920,520 B2 3/2018 Udagawa et al.
10,390,611 B2 8/2019 Lee
10,413,063 B2 9/2019 Lee
2003/0102706 A1 * 6/2003 Float ..... A61G 5/1067 297/440.2
2003/0168901 A1 9/2003 Wilkerson et al.
2006/0006715 A1 1/2006 Chadwick et al.
2008/0277542 A1 * 11/2008 Hwong ..... A47C 7/448 248/200
2008/0290712 A1 11/2008 Parker et al.
2010/0148554 A1 * 6/2010 Yang ..... A47C 7/405 297/291
2012/0126072 A1 5/2012 Pettersson
2012/0304441 A1 12/2012 Henriott
2013/0204438 A1 8/2013 Hjelm
2014/0077548 A1 * 3/2014 Peterson ..... A47C 7/004 297/284.4
2014/0361593 A1 * 12/2014 Kaloustian ..... A47C 3/04 297/353
2017/0042333 A1 * 2/2017 Tsai ..... A47C 7/405
2017/0226749 A1 8/2017 Fjetland
2019/0365089 A1 12/2019 Lee

* cited by examiner

CHAIR AND METHOD OF MAKING THE CHAIR

CROSS-REFERENCE TO RELATED APPLICATIONS

The present application claims priority to U.S. Provisional Patent Application No. 63/210,214, filed on Jun. 14, 2021.

FIELD

The present innovation relates to chair and methods of making chairs.

BACKGROUND

Examples of articles of furniture can be appreciated from U.S. Patent Application Publication Nos. 2019/0365089, 2013/0204438 and 2012/0126072 and U.S. Pat. Nos. 10,413,063, 10,390,611, 9,585,468, 9,265,340, 9,185,973, 8,667,909, 8,256,359, 8,056,489, 6,546,880, 6,536,357, 6,389,988, 6,029,587, 5,941,182, 5,881,979, 5,715,761, 5,706,739, 5,598,789, 5,562,052, 5,224,429, 5,408,940, and 4,604,955. Examples of other types of articles of furniture can be appreciated from U.S. Pat. Nos. 9,920,520, 8,365,798, 7,789,025, 7,310,918, 6,896,028, 6,367,213, 6,002,613, 6,000,180, 5,966,879, 5,675,946, 5,680,893, 5,287,909, 4,325,597, 4,248,325, and 2,821,450, U.S. Design Pat. Nos. D800,459, D796,216, D653,862, D458,040, D457,359, and D427,783 and U.S. Patent Application Publication Nos. 2017/0226749 and 2012/0304441.

Examples of furniture systems that can be used in organizing or decorating interior spaces of buildings such as offices or homes can be appreciated from U.S. Pat. Nos. 9,730,513, 8,347,796, 8,132,371, 6,167,664, 6,067,762, 5,943,966, 5,906,420, 5,328,260, 5,309,686, 5,086,597, 4,567,698, 4,546,889, 4,382,642, 4,325,597, and 2,821,450.

Examples of chairs can be appreciated from U.S. Pat. Nos. 8,216,416, 8,167,373, 8,157,329, 8,029,060, 7,887,131, 7,198,329, 6,824,218, and 6,817,667 and U.S. Pat. App. Pub. Nos. 2003/0168901, 2006/0006715, and 2008/0290712. Chairs often have a seat on which a user can sit. The chair can also include a back on which the back of a user can rest while the user sits on the chair. Some chairs may be configured to have a back that tilts from an upright position to a recline position.

SUMMARY

We have determined that there is a need for a chair that can facilitate improved options for chair back positioning and attachment. For example, chair backs often need to be coupled to a frame at multiple different upper, lower, and side locations to support a back skin in a desired position. A new chair that can permit improved chair back positioning options while also permitting an easier process for incorporating the chair back into the chair when manufacturing the chair can provide improved aesthetic design options for a chair as well as improvements in manufacturing efficiency, which can reduce the costs for making the chair and may also improve the speed at which chairs can be fabricated.

Embodiments of the chair can include a seat and a chair back spaced apart from the seat to define a gap between a bottom portion of the chair back and a rear portion of the seat. The chair can also include a base that supports the chair back and the seat. The base can have a frame. The seat can be attached to the frame and the chair back can be attached to the frame via at least one chair back attachment mechanism. Each chair back attachment mechanism can include an intermediate chair back attachment body having intermediate chair back attachment body fastener holes defined therein that are each sized and configured for receiving a chair back attachment body fastener so that the chair back attachment body fastener is passable through the intermediate chair back attachment body so a head end of the chair back attachment body fastener is in contact with or engagement with a front portion of the intermediate chair back attachment body and a shaft end of the chair back attachment body fastener is positionable within a hole defined in a chair back attachment receptacle of the frame. The intermediate chair back attachment body can also have a chair back fastener hole that is between the spaced apart chair back attachment body fastener holes to receive a shaft portion of a chair back fastener that is passable through an upper portion of the chair back.

In some embodiments, the intermediate chair back attachment body can have an ovoid shape and the chair back fastener hole can be positioned within a central portion of the intermediate chair back attachment body between the intermediate chair back attachment body fastener holes. In some arrangements, there can be two intermediate chair back attachment body fastener holes and a single chair back fastener hole. In other arrangements, there may be more than two intermediate chair back attachment body fastener holes and at least one chair back fastener hole.

In some embodiments, the intermediate chair back attachment body can have an ovoid shape or a polygonal shape. For instance, the shape of the intermediate chair back attachment body can be generally oval-like, generally hexagonal-like, generally octagonal-like, or have other type of polygonal or oval-like shape. The intermediate chair back attachment body can be comprised of a metal or can be comprised of another suitable material (e.g. composite material, etc.).

The frame of the base of the chair can be configured to support the seat and the chair back. In some embodiments, the frame can include a plurality of legs that include a front right leg, a front left leg, a rear left leg and a rear right leg. The frame can also include a plurality of seat support members connected to the legs. The seat support members can be positioned to support the seat and define an opening between the seat support members.

The frame of the base can also include an n-shaped back support member having a left side portion that extends from the left rear leg and a right side portion that extends from the rear right leg and an upper portion that extends between the right side portion and the left side portion. Alternatively, the fame of the base can also include a back support member having a left side back support member that extends above the left rear leg, a right side back support member that extends above the right rear leg, and a curved upper support member attached to an upper end of the right side back support member and an upper end of the left side back support member. The curved upper support member can have a C-shape or a C-like shape in some embodiments. A right end portion of the curved upper support member can extend forwardly to be positioned as an armrest located above a right side of the seat and a left end portion of the curved upper support member can extend forwardly to be positioned as an armrest located above a left side of the seat.

In some embodiments, the frame can be an integral body molded via a gas assisted polymeric injection molding process or an injection molding process. In other embodiments, the frame can include different components that are welded, bonded, molded, and/or fastened together to form the frame.

The chair back can be an upholstered chair back, a mesh chair back, or a polymeric skin type chair back in some embodiments. The seat can be an upholstered seat, a mesh seat, a polymeric skin type seat, or other type of seat configuration.

A method of making a chair is also provided. Embodiments of the method can include forming a frame of a base, attaching a seat to the frame of the base, and attaching a chair back to the frame of the base so that a bottom portion of the chair back is spaced from a rear portion of the seat to define a gap via at least one chair back attachment mechanism. Each of the at least one chair back attachment mechanism can include an intermediate chair back attachment body having intermediate chair back attachment body fastener holes defined therein that are each sized and configured for receiving a chair back attachment body fastener so that the chair back attachment body fastener is passable through the intermediate chair back attachment body so a head end of the chair back attachment body fastener is in contact with or engagement with a front portion of the intermediate chair back attachment body and a shaft end of the chair back attachment body fastener is positionable within a hole defined in a chair back attachment receptacle of the frame. The intermediate chair back attachment body can also have a chair back fastener hole that is between the spaced apart chair back attachment body fastener holes to receive a shaft portion of a chair back fastener that is passed through an upper portion of the chair back.

The frame that is formed can have a pre-selected design. In some embodiments, the frame can be an integral body molded via a gas assisted polymeric injection molding process or a polymeric injection molding process. In other embodiments, the frame can be formed by welding, adhering, bonding, fastening, and/or molding different frame components together to form the frame.

In some embodiments, the frame that is formed can include a plurality of legs that include a front right leg, a front left leg, a rear left leg and a rear right leg. The frame can also have a plurality of seat support members connected to the legs. The seat support members can be positioned to support the seat and define an opening between the seat support members. The frame of the base can also include at least one back support member positioned for connection to at least one of the legs to support the chair back and facilitate attachment to the intermediate chair back attachment body for each of the at least one chair back attachment mechanism. The at least one back support member can include:

(i) an n-shaped back support member having a left side portion that extends from the left rear leg and a right side portion that extends from the rear right leg and an upper portion that extends between the right side portion and the left side portion; or (ii) a left side back support member that extends above the left rear leg, a right side back support member that extends above the right rear leg, and a curved upper support member between an upper end of the right side back support member and an upper end of the left side back support member.

The intermediate chair back attachment body utilized in the method can include an embodiment of such a body discussed above or below. For instance, the intermediate chair back attachment body can have an ovoid shape and the chair back fastener hole can be positioned within a central portion of the intermediate chair back attachment body between the intermediate chair back attachment body fastener holes. In some arrangements, there can be two intermediate chair back attachment body fastener holes and a single chair back fastener hole. Other arrangements can utilize other numbers of such holes in a different arrangement or orientation of the holes.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of a chair and exemplary embodiments of components of the chair are shown in the accompanying drawings and certain exemplary methods of making and practicing the same are also illustrated therein. It should be appreciated that like reference numbers used in the drawings may identify like components.

DETAILED DESCRIPTION OF EXEMPLARY EMBODIMENTS

Figure 1:
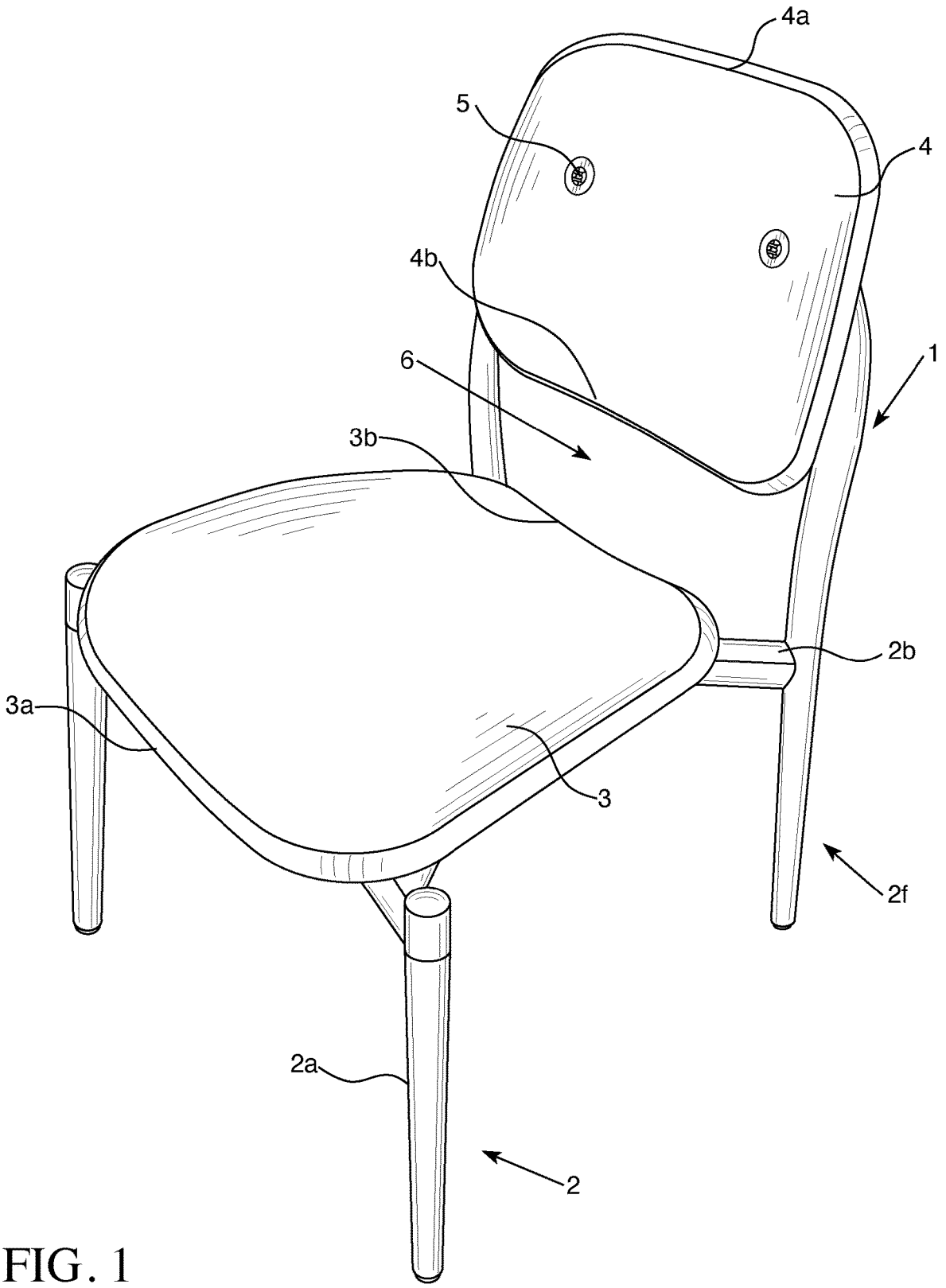
FIG. 1 is a perspective view of a first exemplary embodiment of a chair.
Figure 2:
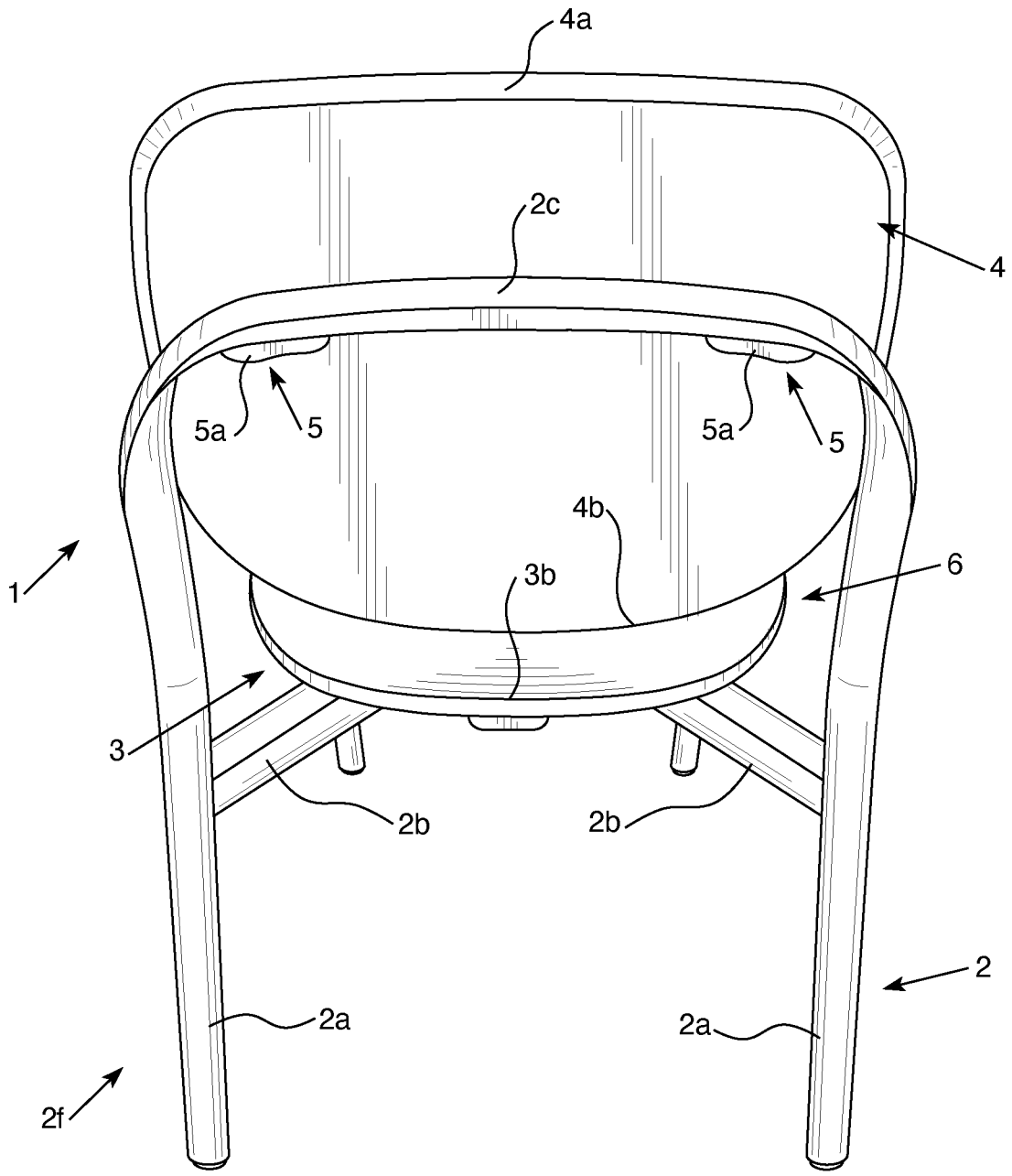
FIG. 2 is a perspective view of the rear side of the first exemplary embodiment of a chair.

Referring to FIGS. 1-6, a chair 1 can include a base 2 that supports a seat 3 and a chair back 4. The chair back 4 can include a back skin that has a top portion 4*a*, a bottom portion 4*b* that is opposite the top portion 4*a*. The chair back can include left and right side portions that extend between the top and bottom portions 4*a* and 4*b* on the left and right sides of the chair back 4. The chair back 4 can be an upholstered back, a chair back 4 having a covering that covers a back frame, or can be structured to include a mesh back skin or other type of chair back configured to contact the back of a seated user to support the user's back when the user sits on the seat. In some embodiments, the chair back 4 can include a frame, at least one cushion or foam sheet retained in or positioned in the frame, and a covering (e.g. a fabric covering, a leather covering, etc.) that covers the cushion or foam and the back frame. In other embodiments, the chair back can include a mesh back skin or a polymeric back skin that is attached to and suspended from a back frame attached to the base 2. In yet other embodiments, the chair back 4 can be comprised of wood, a laminated material, or a composite material.

The seat 3 can include a seat skin that has a front portion 3*a*, and a rear portion 3*b* that is opposite the front portion 3*a*. The seat 3 can include left and right side portions that extend between the front and rear portions 3*a* and 3*b* on the left and right sides of the seat 3. The seat 3 can be an upholstered seat, a seat having a covering that covers a seat frame, or can be structured to include a mesh seat skin or other type of seat configured to contact the buttocks of a seated user to support the user when the user sits on the seat. In some embodiments, the seat 3 can include a frame, at least one cushion or foam sheet retained in or positioned in the seat frame, and a covering (e.g. a fabric covering, a leather covering, etc.) that covers the cushion or foam and the seat frame. In other embodiments, the seat 3 can include a mesh seat skin or a polymeric seat skin that is attached to and suspended from a seat frame attached to the base 2. In yet other embodiments, the seat 3 can be comprised of wood, a laminated material, or a composite material.

The base 2 can include a frame 2*f* that has a plurality of legs 2*a*. Lower distal ends of the legs 2*a* can be attached to feet (e.g. castors, glides, etc.). The legs can extend vertically to engage a floor and support the seat 3 and chair back 4 on the floor. In some embodiments, the base 2 can alternatively include a pedestal base configuration that may include a central leg that is attached to a lower frame having castors, glides, or other feet for contacting and engaging a floor. The frame 2*f* of the base 2 can also include seat support members 2*d* that are attached between the legs to support the seat 3 and at least one back support member 2*c* that is attached to or integral with at least one leg 2*a* and/or at least one seat support member 2*d* for attachment to the chair back 4.

The seat 3 can be fastened (e.g. staples, screws, bolts, nails, and/or combinations of fasteners, etc.) or otherwise attached (e.g. welded, combination of welding and fasteners, combination of adhesive and fasteners, etc.) to the seat support members 2*d* for attachment of the seat 3 to the base 2. The seat support members 2*d* can be structured as beams, rods, tubes, pipes, annular shaped members, hollow members (e.g. tubular beams, plates having an interior cavity, rods having at least one interior cavity, etc.), plates, or other types of support elements. In some embodiments, the seat support members 2*d* can be formed integral with the frame 2*f* via an injection molding process or can be hollow or partially hollow members (e.g. tubular members) formed via a gas-assisted molding process used to form the entire frame 2*f* as a single integral frame body for the base 2.

In some embodiments, the seat support members 2*d* can include a front seat support member 2*d* that extends between a left front leg 2*a* and a right front leg 2*a*, a left seat support member 2*d* that extends between a left front leg 2*a* and a left rear leg 2*a*, a right seat support member 2*d* that extends between a right front leg 2*a* and a right rear leg 2*a*, and a rear seat support member 2*d* that extends between the right rear leg 2*a* and the left rear leg 2*a*. In some embodiments, the left seat support member 2*d* can extend from the left end of the front seat support member 2*d* to the left end of the rear seat support member 2*d* and the right seat support member 2*d* can extend from the right end of the front seat support member 2*d* to the right end of the rear seat support member 2*d*. The seat support members can be positioned to define an inner opening between the seat support members 2*d*. The inner opening can have a rectangular shape, a trapezoidal shape, a circular shape, an oval shape, a polygonal shape (e.g. hexagonal shape, pentagonal shape, etc.) or other type of shape.

The rear seat support member 2*d* can have a first end that is connected to a first rear support leg attachment member 2*b* and a second end opposite its first end that is connected to a second support leg attachment member 2*b*. It should be appreciated that the first end of the rear seat support member 2*d* can be its left end and the second end of the rear seat support member 2*d* can be its right end or the first end of the rear seat support member 2*d* can be its right end and the second end of the rear seat support member 2*d* can be its left end.

Each rear support leg attachment member 2*b* can extend from a respective rear leg 2*a* for connecting to a respective end of the rear support member 2*d* to attach the support member 2*d* to the rear legs 2*a* so the rear support member 2*d* can extend between the rear legs 2*a* in a position that is forward of the rear legs 2*a* (e.g. in front of the rear legs 2*a* or a position that is in front of the rear legs 2*a* such that the rear legs 2*a* are positioned behind and to the left and right sides of the rear support member 2*d*).

Each rear support leg attachment member 2*b* can be structured as beams, rods, tubes, pipes, annular shaped members, hollow members (e.g. tubular beams, plates having an interior cavity, rods having at least one interior cavity, etc.), plates, or other types of support elements. Each rear support leg attachment member 2*b* can be integral with the leg 2*a* from which it extends. For instance, in some embodiments, the rear support leg attachment members 2*b* can be formed integral with the frame 2*f* via an injection molding process or can be hollow or partially hollow members (e.g. tubular members) formed via a gas-assisted molding process used to form the entire frame 2*f* as a single integral frame body for the base 2. In other embodiments, each rear support leg attachment member 2*b* can be fastened to the leg 2*a* from which it extends so its rear end is connected to the leg and its front end is connected to an end of the rear seat support member 2*d*.

The frame 2*f* of the base 2 can also include at least one back support member 2*c* that extends above at least one rear leg 2*a*. In some embodiments, the at least one back support member 2*c* can be an arcuate shaped member that has a right end that is connected to the right rear leg 2*a* and a left end that is connected to the left rear leg 2*a* and has an upper portion that is between its right end and its left end positioned above the rear legs and above the seat 3. In such embodiments, the back support member 2*c* can have a lowercase "n" type shape. An example of this type of shape may best be seen in FIG. 4.

In other embodiments, the at least one back support member 2*c* can include a left side back support member 2*c*L that extends above the left rear leg 2*a*, and a right side back support member 2*c*R that extends above the right rear leg 2*a*. A curved upper support member 2*c*A can be attached to the upper ends of the right side back support member 2*c*R and the left side back support member 2*c*L. A right end portion of the curved upper support member 2*c*A can extend forwardly to be positioned as an armrest located above the right side of the seat 3. A left end portion of the curved upper support member 2*c*A can extend forwardly to be positioned as an armrest located above the left side of the seat 3. In some embodiments, the curved upper support member 2*c*A can have a C-shape. An example of a C-shape configuration for the curved upper support member 2*c*A may best be appreciated from FIG. 5.

The left side back support member 2*c*L that extends above the left rear leg 2*a* and the right side back support member 2*c*R that extends above the right rear leg 2*a* can each be integral with the leg 2*a* from which it extends. For instance, in some embodiments, the left side back support member 2*c*L and the right side back support member 2*c*R can each be formed integral with the frame 2*f* via an injection molding process or can be hollow or partially hollow members (e.g. tubular members) formed via a gas-assisted molding process used to form the entire frame 2*f* as a single integral frame body for the base 2. In other embodiments, the left side back support member 2*c*L and the right side back support member 2*c*R can each be fastened to the leg 2*a* from which it extends so its lower end is connected to the leg from which it extends and its upper end is connected to a portion of the curved upper support member 2*c*A (e.g. at a location that is at an intermediate location positioned between the right end and the left end of the curved upper support member 2*c*A).

The chair back 4 can be attached to the frame 2*f* to position the chair back 4 above the seat 3 so that there is a gap 6 defined between the rear 3*b* of the seat 3 and the bottom portion 4*b* of the chair back 4. The size and shape of this gap 6 can be defined by the shape of the seat 3 and chair back 4 to help provide a pre-selected aesthetic effect for the chair 1.

In some embodiments, the gap 6 can be irregularly shaped, be polygonal shaped, or have an oval or circular type shape. One or more of: (i) the rear legs 2*a*, (ii) portions of the left side back support member 2*c*L that extends above the left rear leg 2*a* and the right side back support member 2*c*R that extends above the right rear leg 2*a* and (iii) left and right side portions of the n-shaped back support member 2*c* can also help define the shape and appearance of the gap 6. In some embodiments, at least options (i) and (ii) or options (i) and (iii) can help define the shape and aesthetic effect of the gap 6. In other embodiments, only a single option from options (i), (ii), and (iii) can also help define the shape and aesthetic effect of the gap 6 defined between the bottom portion 4*b* of the chair back 3 and rear portion 3*b* of the seat 3.

Figure 3:
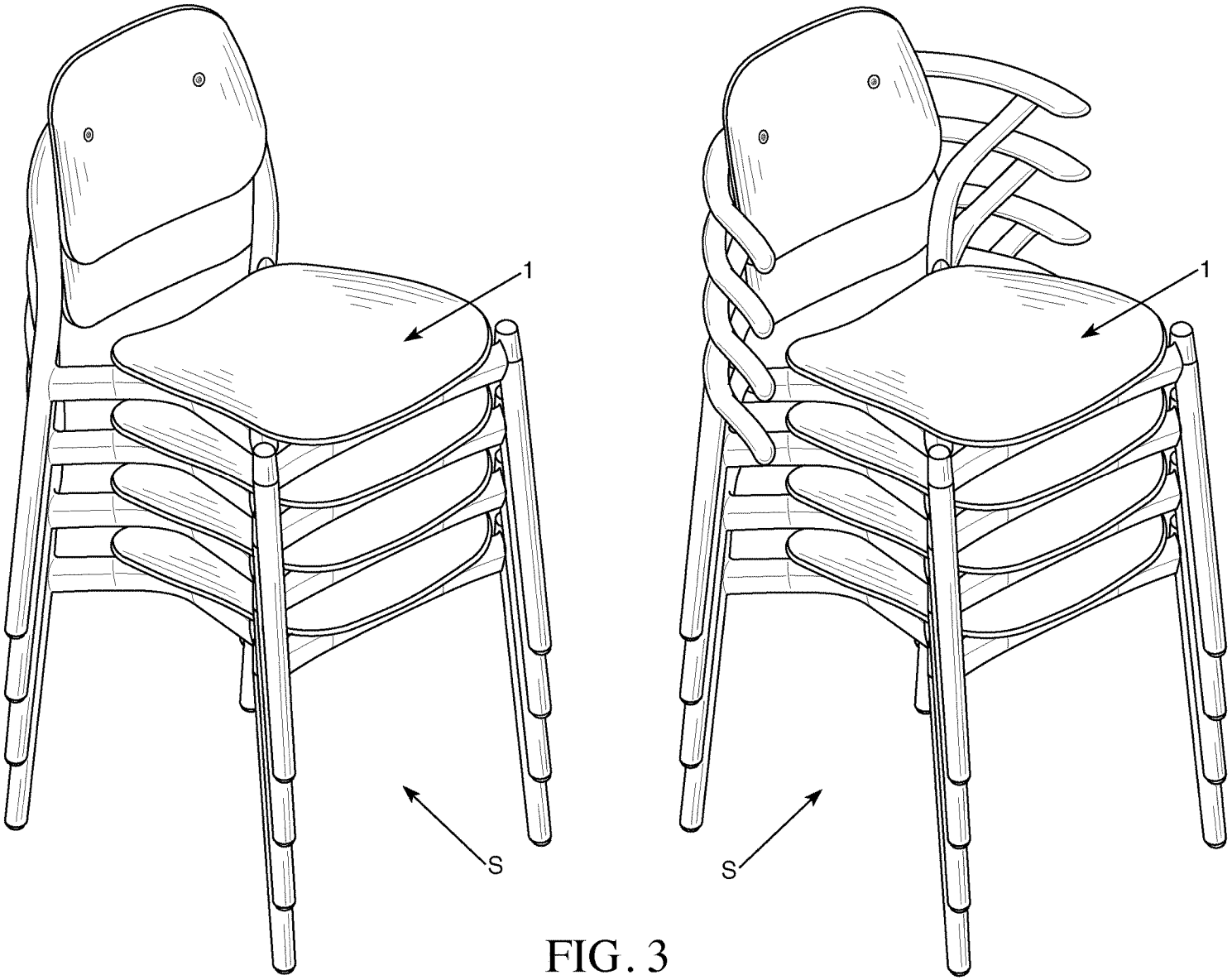
FIG. 3 is a perspective view of exemplary embodiments of the chair that are in stacks S. One stack is of chairs that are armless and the other stack is of chairs that have arms.
Figure 4:
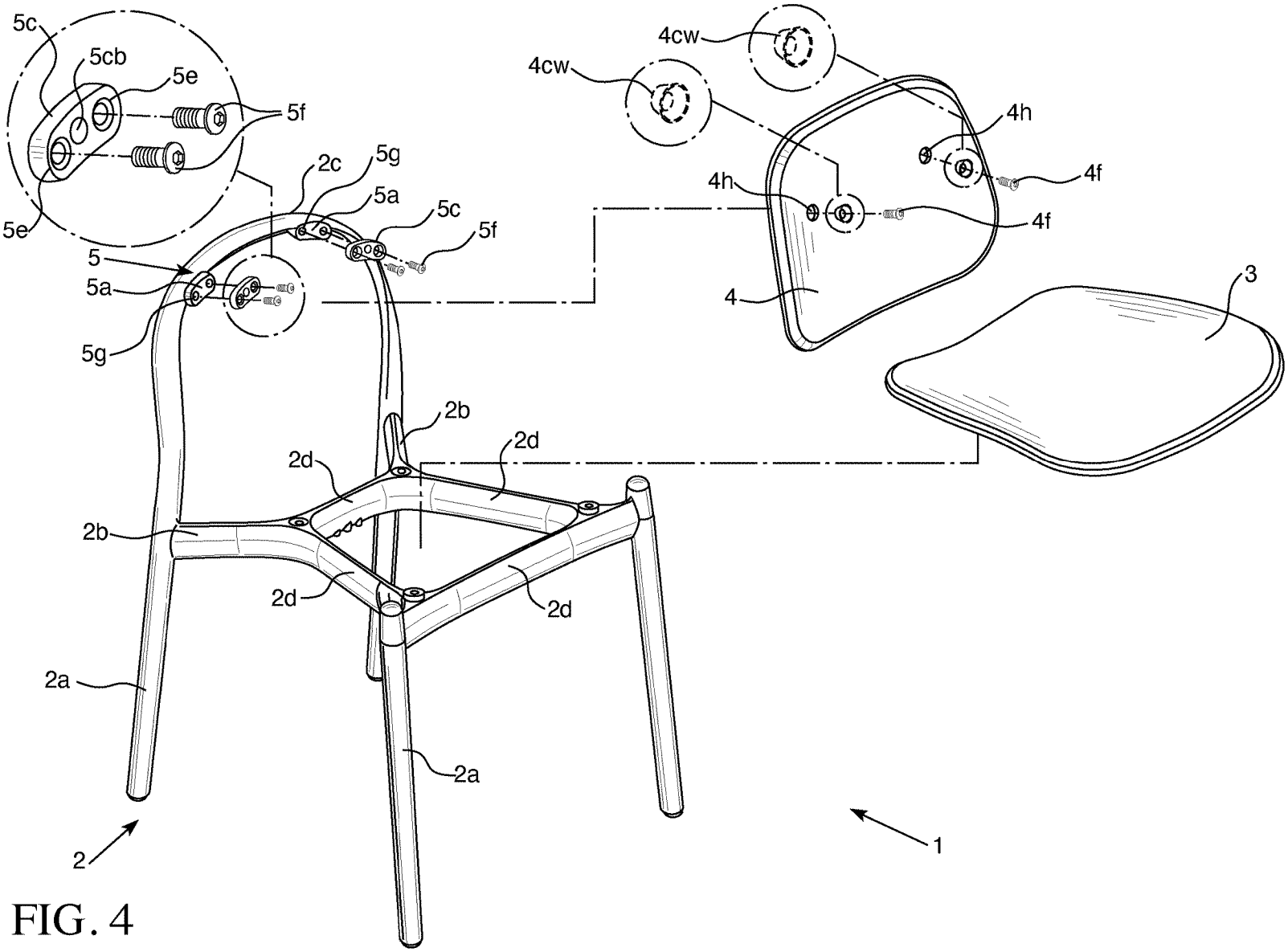
FIG. 4 is an exploded view of the first exemplary embodiment of the chair.
Figure 5:
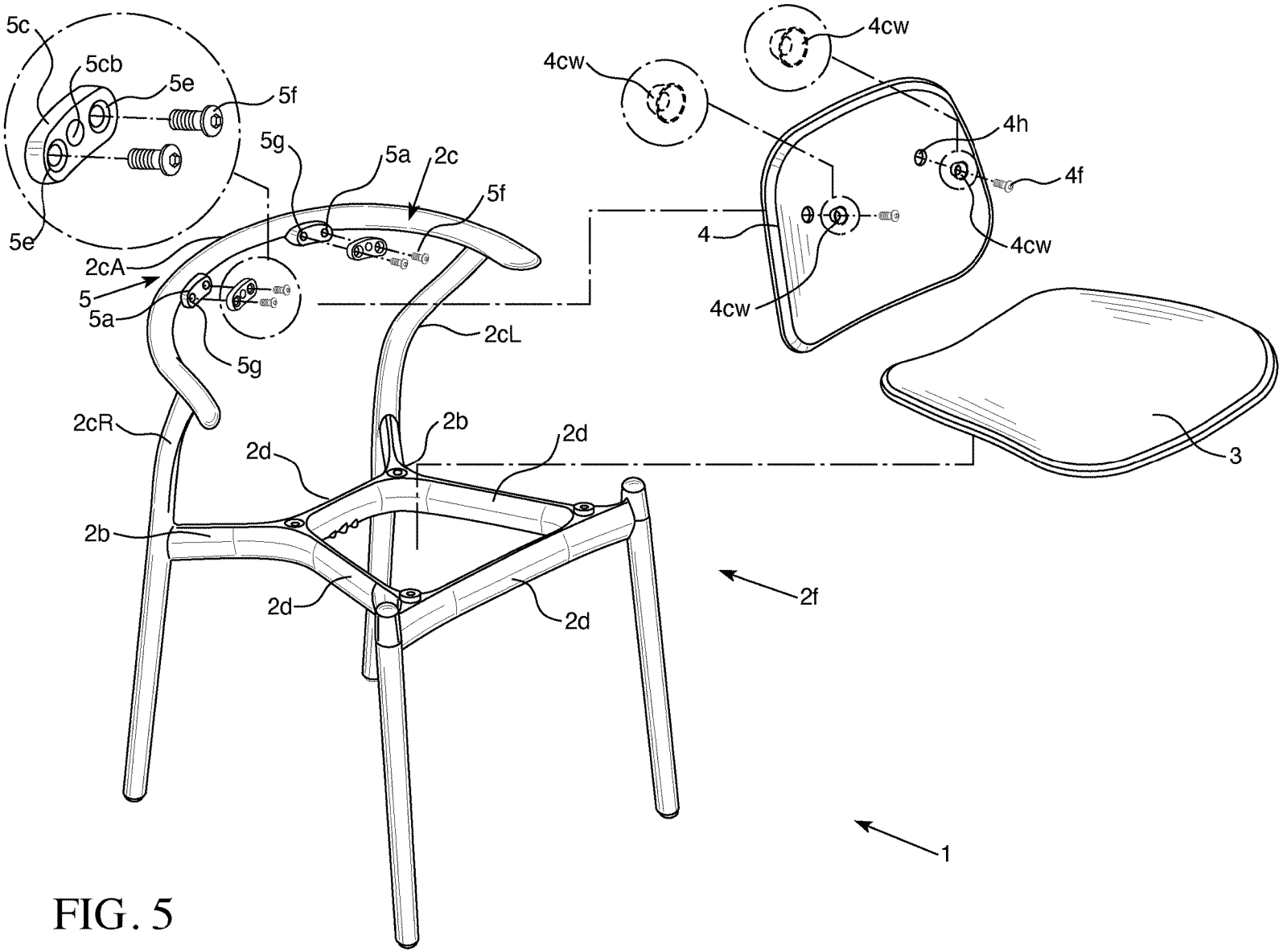
FIG. 5 is an exploded view of a second exemplary embodiment of the chair, which has arms.
Figure 6:
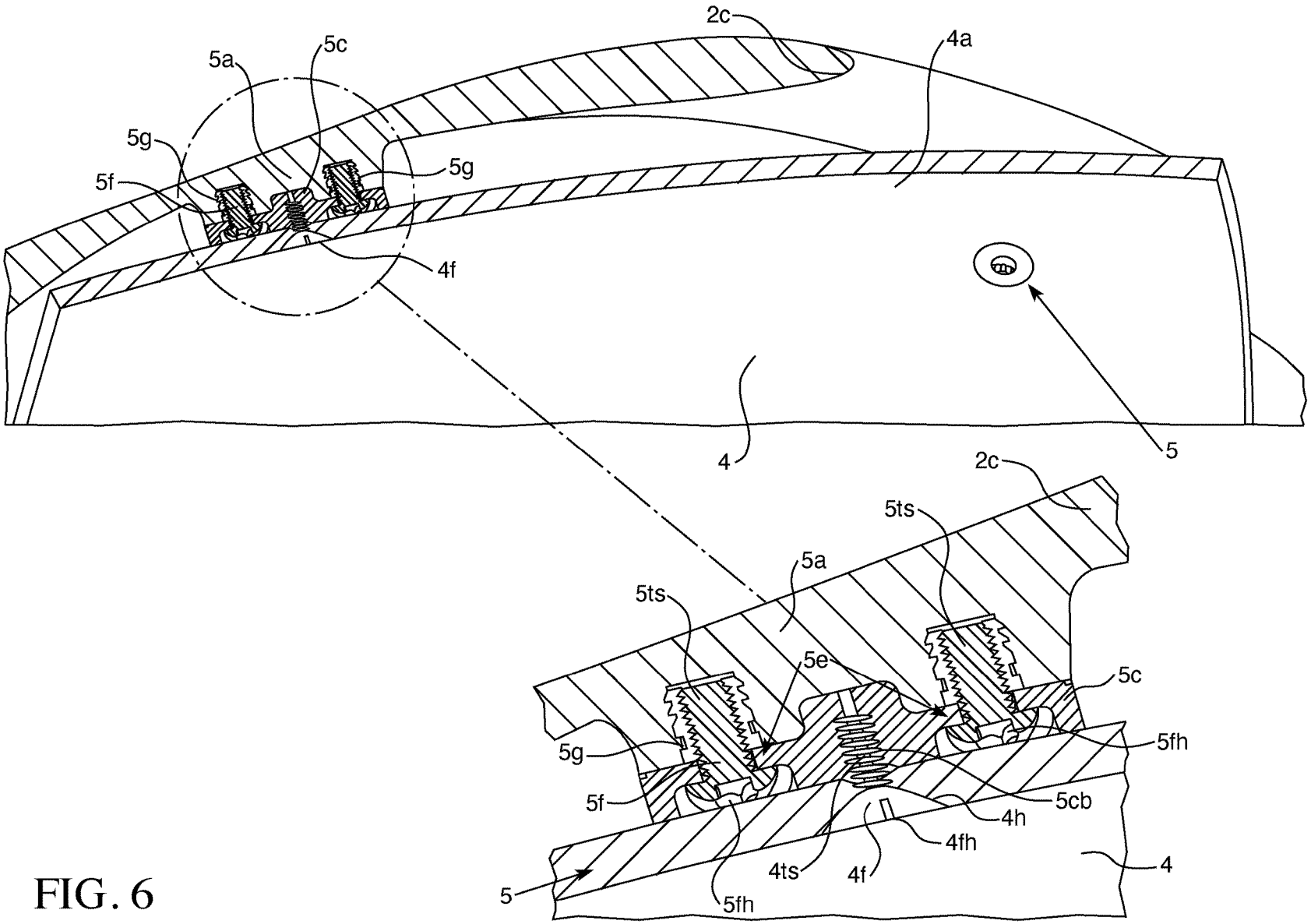
FIG. 6 is a fragmentary view of an exemplary back of the chair that can be included in the first and second embodiments of the chair shown in FIG. 1-5 that also includes an enlarged view of an exemplary chair back attachment mechanism 5 that can be included in the exemplary embodiments of the chair 1.

As may best be seen from FIGS. 4-6, the chair back 4 can be attached to the back support member 2*c* (e.g. the upper portion of the n-shaped back support member 2*c*, the curved upper support member 2*c*A of the back support member 2*c*, etc.) via at least one chair back attachment mechanism 5. In some embodiments (e.g. embodiments shown in FIGS. 1-6), there can be at least two chair back attachment mechanisms 5. It is contemplated, however, that some embodiments can utilize only a single chair back attachment mechanism 5.

Each chair back attachment mechanism 5 can include a chair back attachment receptacle 5*a* defined in a portion of the back support member 2*c* or positioned on a portion of the back support member 2*c* (e.g. defined in a top portion of the n-shaped back support member 2*c*, defined in the curved upper support member 2*c*A of the back support member 2*c*, etc.). Each chair back attachment receptacle 5*a* can be sized and shaped to receive a rear portion of an intermediate chair back attachment body 5*c* and have intermediate chair back attachment body holes 5*g* defined within the receptacle 5*a* that are each sized and configured for receiving a chair back attachment body fastener 5*f*. The holes 5*g* can be threaded holes configured to mate with threads of the chair back attachment body fastener 5*f* (e.g. have threads that mate with threads of a screw, bolt, etc.).

The intermediate chair back attachment body 5*c* can have spaced apart chair back attachment body fastener holes 5*e* for receiving the chair back attachment body fasteners 5*f* so that these fasteners can pass through the intermediate chair back attachment body 5*c* so a head end 4*fh* of each fastener 5*f* is in contact with or otherwise in engagement with a front portion of the intermediate chair back attachment body 5*c* and a shaft end 5*ts* (e.g. a threaded shaft end) of each fastener is mated with and/or positioned within the holes 5*g* defined in the chair back attachment receptacle 5*a*.

The intermediate chair back attachment body 5*c* can also have a chair back fastener hole 5*cb* that is between the spaced apart chair back attachment body fastener holes 5*e*. The chair back fastener hole 5*cb* can be defined to receive a shaft portion of a chair back fastener 4*f* that is passed through a hole 4*h* defined in the upper portion 4*a* of the chair back 4. The head end 4*fh* of the chair back fastener 4*f* can be located on a front side of the chair back 4 when a shaft end 4*ts* (e.g. a threaded shaft end) of the chair back fastener 4*f* is retained within the chair back fastener hole 5*cb* and tightly positioned therein via mating threads between the hole and the fastener or other retention mechanism. The chair back fastener hole 5*cb* can be centrally positioned to be in a central portion of the body of the intermediate chair back attachment body 5*c* and be an equidistant distance from the spaced apart chair back attachment body fastener holes 5*e*.

The chair back 4 can have defined chair back holes 4*h* that are sized to permit the shaft ends 4*ts* of the chair back fasteners 4*f* to pass through the chair back 4 and also contact and retain the head end 4*fh* of the chair back fasteners 4*f*. The chair back holes 4*h* can include an upper right side hole 4*h* and an upper left side hole 4*h*, for example. The left side hole 4*h* can be leftward of a centerline of the chair back 4 and the right side hole can be rightward of a centerline of the chair back 4. Each of the chair back holes 4*h* can be sunken so that a head end 4*fh* of the chair back fastener 4*f* is recessed relative to the outer surfaces of the chair back 4 to avoid contacting the back of a user who may rest his or her back on the chair back 4 or at least minimize contact with the back of a user who may rest his or her back on the chair back 4.

Each fastener 4*f* can be passed through a central hole defined in one or more washers 4*cw* so that at least one washer (shown in broken line in FIGS. 4 and 5) is positioned between the head end 4*fh* of a fastener and the chair back 4. Each washer 4*cw* can be positioned to contact a portion of the chair back 4 adjacent the hole 4*h* and be between the head end 4*fh* of the fastener 4*f* and the front of the chair back 4 when the fastener 4*f* is positioned within the hole 4*h* for attaching the chair back 4 to the intermediate chair back attachment body 5*c* via the chair back fastener hole 5*cb*. In some embodiments, the washers 4*cw* can be annular conical shaped washers. In other embodiments, the washers can be annular washers having another type of shape (e.g. washers shaped as a ring, etc.).

Embodiments of the intermediate chair back attachment body 5*c* can have a body that is ovoid shaped (e.g. shaped like an oval or having an oval shape). Examples of such an ovoid or oval-like shaped body may best be appreciated from FIGS. 4-6. Other embodiments of the intermediate chair back attachment body 5*c* can have different shapes (e.g. rectangular shaped, polygonal shaped, irregular shaped, triangular shaped, pentagonal shaped, trapezoidal shaped, etc.).

The intermediate chair back attachment body 5*c* can be composed of a metal or other material that can be relatively tough and strong. For instance, the intermediate chair back attachment body 5*c* can be composed of steel, an alloy, or other type of metal that has or exceeds a pre-selected toughness threshold and strength threshold. Such material and structural properties can permit a limited number of chair back fasteners 4*f* to be used to attach only an upper portion 4*a* of the chair back to the frame 2*f* of the base 2 for attachment and positioning of the chair back 4. This arrangement can permit a number of options for chair back positioning, shape and sizing of the gap 6, and also make fabrication of the chair a more efficient process. For example, in some embodiments, only two chair back attachment mechanisms 5 can be utilized for only attaching the upper portion 4*a* of the chair back 4 to the frame 2*f* of the base 2 without the left side, right side, and bottom of the chair back being attached to the frame 2*f*. For such embodiments, these two positions can be relatively equidistant from a centerline of the chair back that may pass through a center of the chair back 4.

In other embodiments, there can be another number of spaced apart chair back attachment mechanisms 5 (e.g. just one centrally located one, three spaced apart chair back attachment mechanisms that include a central one that is equidistant from left and right side chair back attachment mechanisms 5, etc.) Each chair back attachment mechanism 5 can be sized and shaped so there is a single central chair back fastener hole 5*cb* for receipt of a single chair back fastener 4*f* that can be between two more chair back attachment body fastener holes 5*e*. Each chair back attachment body 5*c* can be configured so that each chair back attachment mechanism 5 utilizes more chair back attachment body fasteners 5*f* than the single chair back fastener 4*f* that it is sized to receive and retain to facilitate attachment of the chair back 4 to the frame 2*f* of the base 2. This configuration can allow for a sufficiently strong connection of the chair back 4 to the frame 2*f* of the base 2 and help minimize the wear experienced by the chair back 4 from forces acting on the chair back 4 when a user's back engages the chair back 4. This can help extend the life of the chair back and avoid the chair back from becoming damaged after a relatively short period of use. Such functionality can permit the chair back 4 to only be attached to the frame 2*f* of the base 2 at one or only a few (e.g. two, three, four, less than 5) locations at its upper portion 4*a* so that there are increased design options for making a particular chair to have a pre-selected aesthetic effect that can be at least partially defined by the gap 6, position of the seat 3, position of the chair back 4, and frame 2*f* of the base 2.

As may best be appreciated from FIG. 3, embodiments of the chair 1 can be configured to be stackable so that stacks S of chairs 1 can be formed for storage of the chairs 1. Such stackability can help with storage and organization of the chairs 1 by requiring less overall space for storage of non-used chairs while also permitting the stored chairs to be easily deployed in at least one room of a building or other setting for a particular event (e.g. a conference, a meeting, etc.). The stackability of the chair 1 can be facilitated via configuration of the base 2, seat 3, and chair back 4.

A method of fabricating the chair 1 can also be appreciated from FIGS. 1-6. For example, the base 2 can be formed via a molding process. In some embodiments, the entirety of the frame 2*f* of the base can be formed in an injection molding process or a gas assisted injection molding process. The seat 3 and chair back 4 can then be fastened to the frame 2*f*. The chair back 4 can be fastened via use of one or more chair back attachment mechanisms 5 for attachment of the chair back 4 to the frame 2*f* (e.g. via an attachment as discussed above and as may best be seen from FIGS. 4-6 for example). In such a process, each intermediate chair back attachment body 5*c* for each chair back attachment mechanism 5 can be fastened to a respective receptacle 5*a* of the frame 2*f* of the base.

Each receptacle 5*a* of the frame 2*f* of the base 2 can be attached to the frame 2*f*, positioned on the frame 2*f*, or integrated within the frame 2*f* at pre-selected positions (e.g. integrally molded or formed into the frame, bonded or welded to the frame to position or attach the receptacle 5*a* to the frame, fastened to the frame 2*f*, etc.). For example, each receptacle 5*a* can be defined in a portion of the back support member 2*c*, fastened to a portion of the back support member 2*c*, bonded or welded to a portion of the back support member 2*c*, or integrally formed into the back support member 2*c* at a pre-selected position for alignment with a respective chair back hole 4*h*.

Chair back fasteners 4*f* can be provided for attachment of the chair back 4 to the intermediate chair back attachment bodies 5*c* connected to the receptacles 5*a*. For instance, the chair back 4 can be fastened to each intermediate chair back attachment body 5*c* via a chair back fastener 4*f*. The seat 3 can be fastened to the seat support members 2*d* via seat fasteners or other seat attachment mechanism(s) so the seat 3 can be supported on the seat support members 2*d* of the frame 2*f* of the base 2.

Methods of making the chair can also include other steps. For instance, positioning armrest pads on the chair or attaching castors to the legs of the chair can also be performed. As yet another example, attaching glides to the bottom distal ends of the legs 2*a* can be performed.

It should be understood that other modifications to the chair 1 can be made to meet a particular set of design criteria. For example, it is contemplated that a particular feature described, either individually or as part of an embodiment, can be combined with other individually described features, or parts of other embodiments. The elements and acts of the various embodiments described herein can therefore be combined to provide further embodiments. As another example, the base of the chair can be an integrally molded or case structure or can be composed of various separate parts that are fastened and/or adhered together to form the base 2. Therefore, while certain exemplary embodiments of the chair 1, chair back attachment mechanism 5, and methods of making and using the same have been discussed and illustrated herein, it is to be distinctly understood that the invention is not limited thereto but may be otherwise variously embodied and practiced within the scope of the following claims.

What is claimed is:

1. A chair comprising:

a seat;

a chair back spaced apart from the seat to define a gap between a bottom portion of the chair back and a rear portion of the seat;

a base that supports the chair back and the seat, the base having a frame, the seat attached to the frame, the chair back attached to the frame via at least one chair back attachment mechanism, the at least one chair back attachment mechanism including:

an intermediate chair back attachment body having intermediate chair back attachment body fastener holes defined therein that are each sized and configured for receiving a chair back attachment body fastener so that the chair back attachment body fastener is passable through the intermediate chair back attachment body so a head end of the chair back attachment body fastener is in contact with or engagement with a front portion of the intermediate chair back attachment body and a shaft end of the chair back attachment body fastener is positionable within a hole defined in a chair back attachment receptacle of the frame, the front portion of the intermediate chair back attachment body facing toward the chair back and a rear portion of the intermediate chair back attachment body being opposite the front portion;

the intermediate chair back attachment body also having a chair back fastener hole that is between the spaced apart chair back attachment body fastener holes to receive a shaft portion of a chair back fastener that is passed through an upper portion of the chair back, a head of the chair back fastener being positioned at a front of the chair back, a rear of the chair back being opposite the front of the chair back, the rear of the chair back facing toward the front portion of the intermediate chair back attachment body;

wherein the frame of the base comprises:

a plurality of legs that include a front right leg, a front left leg, a rear left leg and a rear right leg;

a plurality of seat support members connected to the legs, the seat support members positioned to support the seat and define an opening between the seat support members;

at least one back support member positioned for connection to at least one of the legs to support the chair back and facilitate attachment to the intermediate chair back attachment body for the at least one chair back attachment mechanism;

wherein the at least one chair back attachment mechanism comprises a first chair back attachment mechanism spaced apart from a second chair back attachment mechanism;

wherein the at least one back support member comprises an n-shaped back support member having a left side portion that extends from the left rear leg and a right side portion that extends from the rear right leg and an upper portion that extends between the right side portion and the left side portion, the rear portion of the intermediate chair back attachment body facing toward the upper portion and the first chair back attachment mechanism attached to the upper portion adjacent the right side portion of the n-shaped back support member and the second chair back attachment mechanism attached to the upper portion adjacent the left side portion of the n-shaped back support member;

wherein the first chair back attachment mechanism includes an annular conical washer positioned between the head of the chair back fastener of the first chair back attachment mechanism and the chair back within a first hole of the chair back so that the head of the chair back fastener is recessed relative to an outer surface of the front of the chair back;

wherein the second chair back attachment mechanism includes an annular conical washer positioned between the head of the chair back fastener of the second chair back attachment mechanism and the chair back within a second hole of the chair back so that the head of the chair back fastener is recessed relative to the outer surface of the front of the chair back; and the first hole of the chair back being spaced apart from the second hole of the chair back.

2. The chair of claim 1, wherein the intermediate chair back attachment body has an ovoid shape and the chair back fastener hole is positioned within a central portion of the intermediate chair back attachment body between the intermediate chair back attachment body fastener holes.

3. The chair of claim 2, wherein there are two intermediate chair back attachment body fastener holes and a single chair back fastener hole.

4. The chair of claim 1, wherein the intermediate chair back attachment body has an ovoid shape or a polygonal shape.

5. The chair of claim 1, wherein the frame is an integral body comprised of a polymeric material.

6. The chair of claim 1, wherein the intermediate chair back attachment body is comprised of a metal.

7. The chair of claim 1, wherein the chair back is an upholstered chair back and the seat is an upholstered seat.

8. A chair comprising:

a seat;

a chair back spaced apart from the seat to define a gap between a bottom portion of the chair back and a rear portion of the seat;

a base that supports the chair back and the seat, the base having a frame, the seat attached to the frame, the chair back attached to the frame via at least one chair back attachment mechanism, the at least one chair back attachment mechanism including:

an intermediate chair back attachment body having intermediate chair back attachment body fastener holes defined therein that are each sized and configured for receiving a chair back attachment body fastener so that the chair back attachment body fastener is passable through the intermediate chair back attachment body so a head end of the chair back attachment body fastener is in contact with or engagement with a front portion of the intermediate chair back attachment body and a shaft end of the chair back attachment body fastener is positionable within a hole defined in a chair back attachment receptacle of the frame, the front portion of the intermediate chair back attachment body facing toward the chair back and a rear portion of the intermediate chair back attachment body being opposite the front portion;

the intermediate chair back attachment body also having a chair back fastener hole that is between the spaced apart chair back attachment body fastener holes to receive a shaft portion of a chair back fastener that is passed through an upper portion of the chair back, a head of the chair back fastener being positioned at a front of the chair back, a rear of the chair back being opposite the front of the chair back, the rear of the chair back facing toward the front portion of the intermediate chair back attachment body;

wherein the frame of the base comprises:

a plurality of legs that include a front right leg, a front left leg, a rear left leg and a rear right leg;

a plurality of seat support members connected to the legs, the seat support members positioned to support the seat and define an opening between the seat support members;

at least one back support member positioned for connection to at least one of the legs to support the chair back and facilitate attachment to the intermediate chair back attachment body for the at least one chair back attachment mechanism;

wherein the at least one back support member comprises a left side back support member that extends above the left rear leg, a right side back support member that extends above the right rear leg, and a curved upper support member between an upper end of the right side back support member and an upper end of the left side back support member, the rear portion of the intermediate chair back attachment body facing toward the curved curbed upper support member;

wherein the at least one chair back attachment mechanism comprises a first chair back attachment mechanism spaced apart from a second chair back attachment mechanism;

wherein the first chair back attachment mechanism includes an annular conical washer positioned between the head of the chair back fastener of the first chair back attachment mechanism and the chair back within a first hole of the chair back so that the head of the chair back fastener is recessed relative to an outer surface of the front of the chair back; and wherein the second chair back attachment mechanism includes an annular conical washer positioned between the head of the chair back fastener of the second chair back attachment mechanism and the chair back within a second hole of the chair back so that the head of the chair back fastener is recessed relative to the outer surface of the front of the chair back;

the first hole of the chair back being spaced apart from the second hole of the chair back.

9. The chair of claim 8, wherein a right end portion of the curved upper support member extends forwardly to be positioned as an armrest located above a right side of the seat and a left end portion of the curved upper support member extends forwardly to be positioned as an armrest located above a left side of the seat.

10. The chair of claim 9, wherein the curved upper support member has a C-shape.

11. The chair of claim 8, wherein the intermediate chair back attachment body has an ovoid shape and the chair back fastener hole is positioned within a portion of the intermediate chair back attachment body between the intermediate chair back attachment body fastener holes.

12. The chair of claim 11, wherein there are two intermediate chair back attachment body fastener holes and the chair back fastener hole is a single chair back fastener hole.

13. The chair of claim 8, wherein the intermediate chair back attachment body has an ovoid shape.

* * * * *